United States Patent [19]

Sato et al.

[11] Patent Number: 4,889,240

[45] Date of Patent: Dec. 26, 1989

[54] BILL HANDLING APPARATUS HAVING RIGHT AND LEFT BILL-SHIFTING MECHANISMS

[75] Inventors: Koichi Sato; Tsutomu Sawa, both of Fujisawa, Japan

[73] Assignee: International Business Machines, Armonk, N.Y.

[21] Appl. No.: 244,696

[22] Filed: Sep. 14, 1988

[30] Foreign Application Priority Data

Nov. 20, 1987 [JP] Japan ..... 62-292259

[51] Int. Cl.[4] ..... B07C 5/00; B07C 5/36

[52] U.S. Cl. ..... 209/534; 209/539; 235/475; 271/3.1; 271/251; 271/252

[58] Field of Search ..... 209/534, 539, 540, 541, 209/542; 271/3.1, 251, 252; 235/475, 483, 484, 485

[56] References Cited

U.S. PATENT DOCUMENTS 4,438,918 3/1984 Ito et al. ..... 271/251
4,482,147 11/1984 Hibi et al. ..... 271/251 X
4,517,451 5/1985 Kokubo et al. ..... 209/534 X
4,549,661 10/1985 Horishita et al. ..... 209/534
4,552,350 11/1985 Nagy et al. ..... 209/534 X
4,775,142 10/1988 Silverberg ..... 271/251
4,828,243 5/1989 Ebihara ..... 209/534

FOREIGN PATENT DOCUMENTS 56-33757 4/1981 Japan ..... 209/534

*Primary Examiner*—Donald T. Hajec
*Attorney, Agent, or Firm*—Perman & Green

[57] ABSTRACT

A circulation-type bill deposit and dispensing apparatus, is provided with a shift mechanism which moves the bills to a predetermined position to the left or right side with respect to their feed direction so as to eliminate dispersion of bills in the lateral direction. Thus errors in discrimination of truth or falsehood or in discrimination of denominations and feed jams are prevented. An inverse shifting mechanism is also provided for moving bills to the opposite side from the initial shift (with respect to the feed direction) by a predetermined amount.

7 Claims, 4 Drawing Sheets

BILL HANDLING APPARATUS HAVING RIGHT AND LEFT BILL-SHIFTING MECHANISMS

FIELD OF THE INVENTION

The present invention is related to a circulation-type bill deposit and dispensing apparatus which is used in a financial agency like a bank. More specifically, the invention comprises a bill deposit and dispensing apparatus wherein the received bills are stored in storage boxes (stackers) for their respective denominations after they are automatically discriminated for truth or falsehood, and then the bills in the storage boxes are selectively fed out and dispensed for payment.

BACKGROUND OF THE INVENTION

In circulation-type bill deposit and dispensing apparatus, it is required to collectively load or collectively unload bills. The laid-open Patent Application No. 33757/1981 discloses a circulation-type bill deposit and dispensing apparatus having such a function. Such apparatus is provided with a removable collecting storage box capable of storing bills of any denomination in addition to storage boxes for the respective denominations. It has a collective loading function wherein the collective storage box containing bills of each denomination is mounted on the body of the apparatus at the start of business. Those bills are sequentially fed out, discriminated with respect to their denomination and stored in storage boxes corresponding to the different denominations. It further has a collective unloading function wherein the bills in each different denomination storage box are fed out and stored in the collective storage box after careful examination.

Usually, in a circulation-type bill deposit and dispensing apparatus, it is required to feed bills at high speed. However, the edges of bills come in contact with fixed objects such as side walls of the feed path, which may cause a feed jam. To prevent this, the width of the feed path is increased and the bills are fed by rollers or belts. However, in this kind of bill feed mechanism, skid or side slip can easily occur in the feed path when the bills are fed out one by one from a stack of bills. In addition, it is likely that when the bills being fed at high speed are released into a free space and stacked (for example, in an escrow or a stacker), the bills tend to skid in the longitudinal direction thereof.

This skid can be restricted to some extent by the side walls of the storage box but, if the spacing between the side walls is not made large enough, jams will occur. Accordingly, the width of the storage box is made considerably larger than that of bills. Therefore, the bills fed out from such a storage box may have been shifted in the lateral direction, and when these bills are collectively loaded or unloaded, a feed jam, failure of denomination discrimination, or a stacking jam in the storage box can occur.

It is an object of the invention to provide a circulation-type bill deposit and dispensing apparatus in which feed failure and discrimination failure due to skid of the bills is prevented.

SUMMARY OF THE INVENTION

In the present invention, the above described problems are solved by providing, in a circulation-type bill deposit and dispensing apparatus, a shift mechanism which moves the bills to a predetermined position to the left or right side with respect to their feed direction so as to eliminate dispersion of bills in the lateral direction. Thus errors in discrimination of truth or falsehood or in discrimination of denominations and feed jams are prevented.

An inverse shifting mechanism is also provided for moving bills to the opposite side from the initial shift (with respect to the feed direction) by a predetermined amount. For example, the bills to be re-discriminated or the bills fed out from the storage box for collective loading or collective unloading are so shifted.

DETAILED DESCRIPTION OF THE INVENTION

Figure 1:
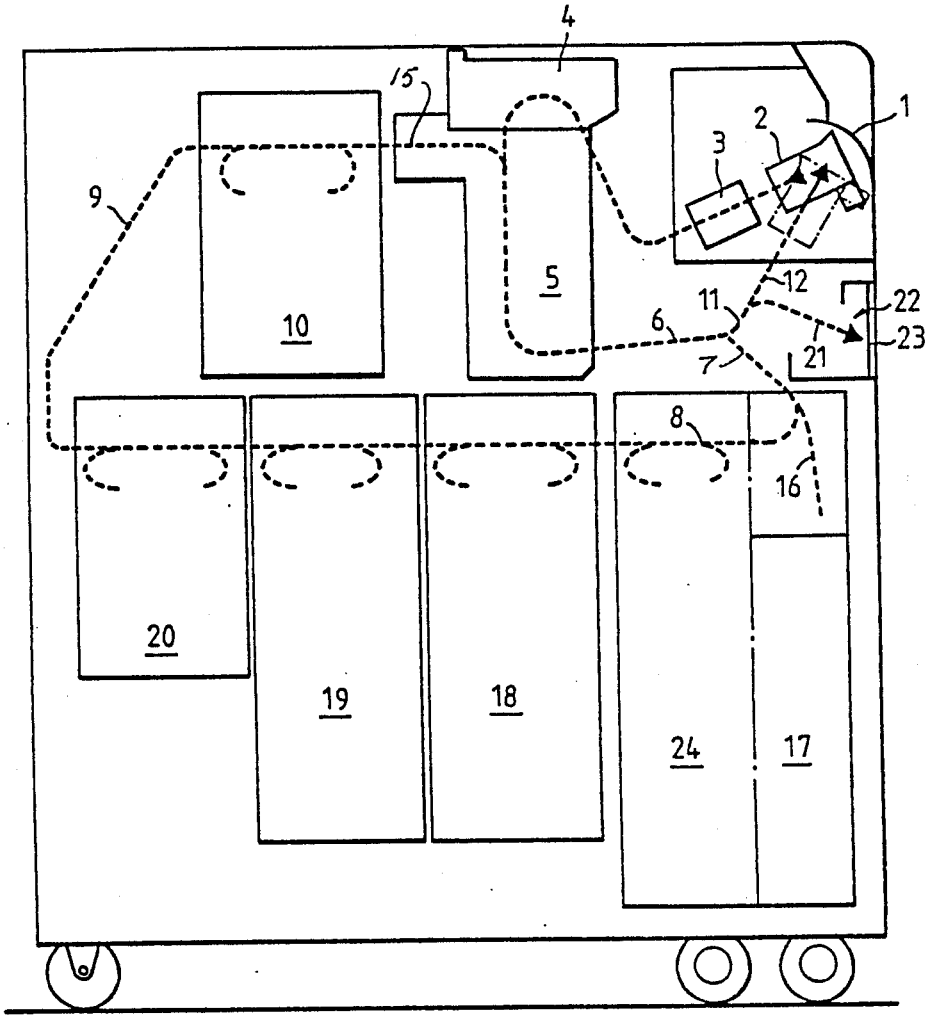
FIG. 1 is a schematic diagram of a bill deposit and dispensing apparatus incorporating the present invention.

Bill deposit, bill dispensing, collective unloading and collective loading operations will be described hereinafter with respect to FIG. 1.

(a) Bill deposit operation

In bill depositing, a shutter 1 opens and bills to be deposited are introduced by the operator into a bill receiving and return box 2. Then, those bills are collectively sent into a feeder box 3, from which they are fed out, one by one. Each bill fed out in this way is shifted by a shifting mechanism 4 to a predetermined position to the left side of the feed path direction so that when the bills arrive at bill discriminator mechanism 5, all the bills are aligned in the width direction along the left side of the feed path, (regardless of denomination) and easily pass through the discriminator mechanism. Therefore, accurate discrimination of the truth or falsehood is possible in bill discriminator mechanism 5. Bills which are discriminated as true are sent through feed paths 6, 7, 8, and 9 to a temporary reservoir or escrow 10, and are reserved until the transaction is finished. Bills which are discriminated as false and abnormally fed bills (skewed, doubled etc.) are returned through feed paths 6, 11, and 12 into box 2 which is rotated downwardly to the return position.

When the bills in box 3 have been fed out, box 2 rotates upward from the bill receiving position, and the bills therein are passed into the box 3 and fed out again for re-discrimination. However, the bills returned from discriminator mechanism 5 through the feed paths 6, 11, and 12 to box 2 tend to be skewed or skidded (side-slipped) to the right or left with respect to the feed direction. When the bills which side-slipped to the left are sent again to shifting mechanism 4 from box 3, if they have moved to the left beyond the predetermined side position of the shifting mechanism, they can collide with the edge of the left side wall before they are again shifted, and produce a jam. For this reason, an inverse shifting mechanism (shown in FIGS. 3A, 3B, and 3C) is provided in association with box 2 and causes the bills, (being moved for re-discrimination) to be moved to the right (in their lateral direction) by a predetermined distance, and then supplied to box 3. Thus, when the bills again pass through the shifting mechanism 4, the shifting operation occurs without the bills colliding with the edge of the left side wall as they enter shifting mechanism 4. The bills which have been discriminated as true by re-discrimination are sent to the escrow 10 to be temporarily reserved, whereas the bills which have been again discriminated as false are sent to the box 2, from which they are taken out by the operator. The number of re-discriminations may be varied by the program.

If there is no operator indication to cancel the transaction or if the transaction is completed, the bills reserved in escrow 10 are sent again through feed path 15 to discriminator mechanism 5, one by one, to be discriminated for their denomination. The denomination discrimination is substantially the same operation as the discrimination for truth or falsehood, but the difference is that the decision level is lower than the discrimination for truth or falsehood.

In the denomination discrimination, the bills discriminated as unsuitable for reuse, because they are damaged, are sent through feed paths 6, 7, and 16 to a box 17 for recovery of damaged bills. The bills discriminated as reusable are sent to and stored in storage boxes for the respective denominations, namely, a ten-thousand-yen bill stacker 18, a thousand-yen bill stacker 19 or a five-thousand-yen bill stacker 20 in accordance with the results of the denomination discrimination. If an instruction to cancel the transaction is issued, the bills in escrow 10 are all returned through feed paths 15, 6, 11 and 12 to box 2.

(b) Bill dispensing operation

When a bill dispense command is given from the host computer, the bills corresponding to the specified denominations and amounts, are fed out from the corresponding stackers, one by one, and dispensed to a bill dispensing portion 22 through the feed path 9, 15, 6, 11 and 21. In feeding the bills to be dispensed, the denomination discrimination is performed in discriminator mechanism 5, and the amount to be dispensed is checked. Also, a bill feed error such as double taking-out, is checked. The bills for which any error is detected are put in a damaged bills recovery box 17 through paths 7 and 16. When bills of the specified denominations and amounts are dispensed to the tray of the bill dispensing portion 22, the gate 23 of the dispensing port opens and the tray slants left or right so that the operator can access them.

(c) Collective unloading operation

In the detailed audit at the close of the business, the bills in the each stacker are sequentially fed out, passed through the feed paths 9, 15, 6, 11, and 12, and stacked in box 2 which has been moved to the return position. As stated above, since some of the bills stored in the stackers might have been caused to skid when fed into the stackers (after being shifted to the left at the time of bill deposit), the bills stacked in box 2 may be dispersed in the lateral direction. Therefore, when a predetermined quantity of bills are stacked, the stack is shifted to the right by the inverse shifting mechanism and is then supplied to the feeder box 3. The bills are then sent out one by one, shifted left by shifting mechanism 4, and discriminated by discriminator mechanism 5 as to their denominations. Further, all of those bills are stored in a cartridge 24 through feed paths 6, 7, and 8. In this way, the quantity of bills in each stacker is checked, fully examined, and then unloaded to cartridge 24.

(d) Collective loading operation

Since, at the start of the business, all of stackers are empty, it is necessary to load them with the bills for dispensing. Thus, the operator mounts cartridge 24, containing bills of each denomination, in the body of the apparatus. In response to a load command from the host computer, the apparatus feeds the bills, one by one, from cartridge 24 through the feed paths 9, 15, 6, 11, and 12 and stacks them in box 2, which has been moved to the return position. As mentioned above, since these bills are shifted to the left when collectively unloaded and are stored in cartridge 24, (and caused to skid during the feeding), the bills stacked in box 2 are dispersed in the lateral direction. Thus, when a predetermined quantity of bills are stacked, the entire stack is shifted to the right by the inverse shifting mechanism and then supplied to feeder box 3. They are then sent out, one by one through shifting mechanism 4; discriminated for their denominations in discriminator mechanism 5; and stored in the stackers corresponding to the denominations. Bills of various denominations are thus automatically loaded.

The structure and operation of the shift mechanism will be described with reference to FIG. 2. Each denomination of bill is fed in a direction parallel to its short side, and the shift mechanism aligns the left side of each bill with a predetermined position and feeds it forward. As shown, a feed roller 31 is provided, the surface of which is coated with urethane rubber having a small coefficient of friction. A guide 33 is provided at the left side of feed roller 31 (with respect to the feed direction), and it serves as a wall against which a bill abuts when it is shifted. Around the upper half of feed roller 31, there is provided two pairs of skew rollers 34 made of urethane rubber with a high coefficient of friction. Rollers 34 are fixed so that, when a bill is fed around roller 31, they rotate in contact with the bill, in a slanted manner with respect to the feed direction, so as to push bill 32 toward guide 33. That is, the skew rollers 34 are biased toward guide 33 by a spring 35, and, when no bill is being fed by feed roller 31, they rotate while slipping at an angle where friction between each skew roller 34 and the feed roller 31 and the force of the spring 35 are balanced. Since the frictional force between bill 32 and feed roller 31 is smaller than the frictional force between bill 32 and skew rollers 34, bill 32 slips on the roller 31 toward guide 33 due to the force of the spring 35 and, when it abuts against guide 33, it is fed forward. In this manner, the left-shift is accomplished.

The structure and operation of the inverse shifting mechanism will now be described. The inverse shifting mechanism is for shifting the fed bills by a predetermined amount in the direction opposite to that previously stated, or to the right with respect to the feed direction, thereby preventing the bill from colliding with the front edge portion of guide 33 (FIG. 2) when it is sent again into the shifting mechanism. In this embodiment, all bills stacked in the box 2 in the return position are first moved to the right in a lateral direction, and then supplied to feeder box 3.

Figure 3A:
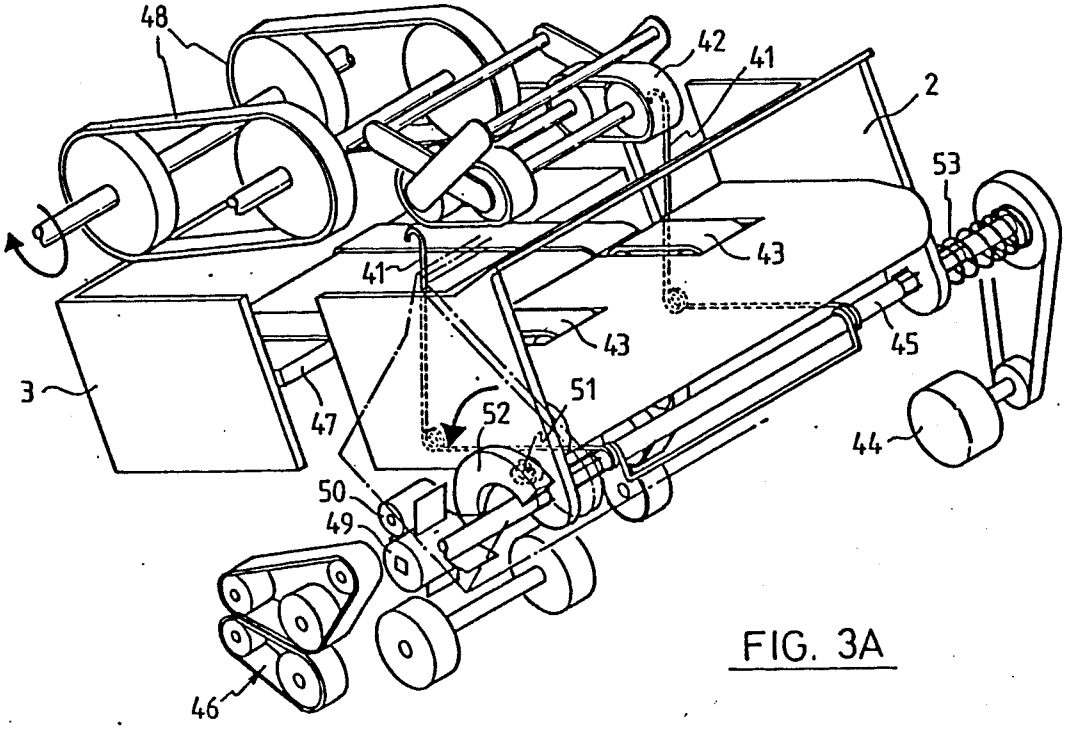
FIG. 3A is a perspective view showing the inverse shifting mechanism.
Figure 3B:
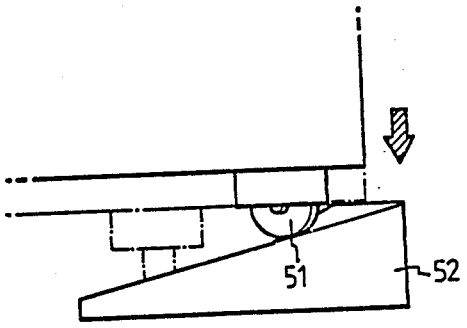
FIG. 3B is a plan view of the cam mechanism portion in the inverse shifting mechanism.
Figure 3C:
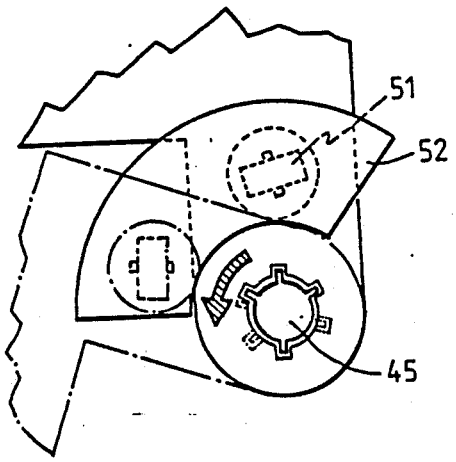
FIG. 3C is a side view of the cam mechanism portion.

FIGS. 3A to 3C illustrate the structure and operational principles of the inverse shifting mechanism. In bill dispensing, the bills introduced in bill receiving and return box 2 are stacked therein while abutting against the two stoppers 41. Then stoppers 41 are pressed down below the box 2 by lowering the upper belts 42 until they contact the bills, and simultaneously the bills in the box 2 are collectively forwarded into the feeder box 3 by driving the upper belts 42 and lower belts 43. Then, box 2 is rotated counterclockwise around shaft 45 by motor 44 to the return position so that it can receive, and stack bills conveyed by feed belt 46.

When the bills are then forwarded into feeder box 3, a presser board 47 rises and presses the bills against feeder belts 48, and simultaneously feeder belts 48 are driven to cause the bills to be fed out one by one from the top. The bills fed out in this way are individually shifted by the shifting mechanism, to the left with respect to the feed direction as described above.

On the other hand, the bills conveyed by the feed belt 46 at the time of collective loading or re-discrimination are forwarded by a film covered, roller 49 and a pinch roller 50, into box 2 while it is in the return position (as shown by a chained line). As will be recalled these bills were all shifted to the left by the shifting mechanism, and include some which have skewed and skidded in the later transportation.

Figure 2:
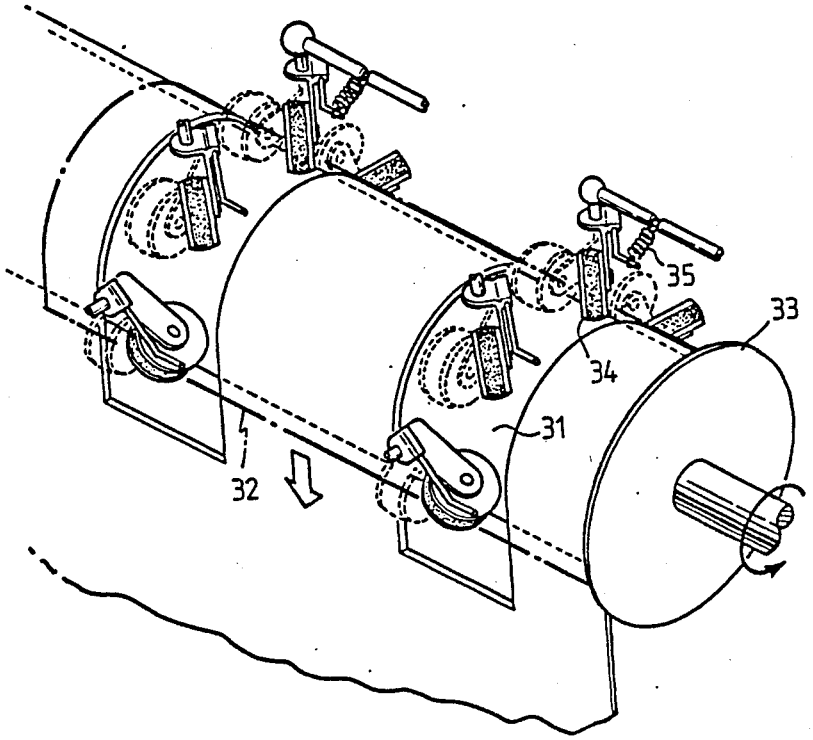
FIG. 2 is a perspective view showing the shifting mechanism.

The inverse shifting achieved by the present invention is performed during the rotation of box 2 from the return position, clockwise to the bill receiving position as shown by the solid line illustration of FIG. 2. FIG. 3B and FIG. 3C show box 2 in the bill receiving position by a solid line illustration and in the return position by a chained line. As shown in FIG. 3C, since box 2 is coupled to shaft 45 by means of splines, the torque exerted by shaft 45 is transmitted thereto, but box 2 is adapted to move freely along the axis of the shaft. Box 2 is provided with a bearing 51 in the side thereof, and is pressed by a spring 53 against a cam 52 fixed to the body of the apparatus. Cam 52 is formed so that it is in its leftmost position when box 2 is in the return position and in its rightmost position when the box 2 is in the bill receiving position. Therefore, the bills sent into the box 2, while it is in its return position are inversely shifted by being moved to the right due to the cam action between the bearing 51 and the cam 52 when the box 2 is rotated to the bill receiving position.

Similarly to the above-mentioned shift mechanism, a mechanism for performing the shift in the opposite direction through the use of a roller, may be provided as the inverse shifting mechanism in the feed path, (for example, located immediately after the discriminator mechanism). Also, by providing a feed belt running diagonally from the bill return port to the bill receiving port, the entire stack of bills in the return port can be sent obliquely. Inverse shifting may also be performed by increasing the width of the bill receiving port to receive the bills that have been circulated into the bill receiving port and pushing them from the left and right to a predetermined position to supply them to the feeder mechanism.

F. Effect

By providing a shifting mechanism to prevent the deviation of the bill position in the discriminator mechanism, the accurate discrimination of a bills truth or falsehood is enabled, and by providing an inverse shifting mechanism, a feed jam in the shifting mechanism is prevented. Thus automatic collective unloading, collective loading and re-discrimination of bills are enabled.

We claim:

1. A bill handling apparatus comprising:

a holder mechanism for receiving and holding bills supplied thereto;

a feeder mechanism for receiving bills from said holder mechanism and feeding them out one by one over a feed path in a feed direction;

a transfer mechanism for transferring bills from said holder mechanism to said feeder mechanism;

a shifting mechanism for shifting bills fed from said feeder mechanism to one side of said feed path;

an inverse shifting mechanism for inversely shifting the bills to be transferred by said transfer mechanism, by moving them to a side of said feed path opposite to said one side by a predetermined distance; and a discriminator mechanism for discriminating whether the bills shifted by said shifting mechanism are true or false.

2. The invention as recited in claim 1 further comprising:

a feed path mechanism for returning the bills discriminated as false by said discriminator mechanism to said holder mechanism.

3. The invention as recited in claim 2 wherein said inverse shifting mechanism acts on said holder mechanism to accomplish said inverse shift of said bills.

4. The invention as recited in claim 3 wherein said inverse shifting mechanism actuates a portion of said holder mechanism to move a stack of said bills to said opposite side.

5. The invention as recited in claim 4 wherein said shifting mechanism shifts individual bills as they are fed from said feeder mechanism.

6. The invention as recited in claim 5 wherein said shifting mechanism includes biased roller means which frictionally engage each said bill and move it to said one side.

7. The invention recited in claim 1, wherein said apparatus handles bills of a plurality of denominations, the combination further comprising:

a plurality of denominational storage means, each for storing bills of a single denomination;

a removable storage means for holding all denominations of bills; and a second feed path mechanism for moving bills stored in said denominational storage means to said holder mechanism.

* * * * *